US005379786A

United States Patent [19]

Lynam

[11] Patent Number: 5,379,786

[45] Date of Patent: Jan. 10, 1995

[54] FOLDING WINDBREAK AND SHADE SCREEN SYSTEM

[76] Inventor: Donald K. Lynam, 2020 S. Atlantic Ave., Daytona Beach Shores, Fla. 32118

[21] Appl. No.: 929,512

[22] Filed: Aug. 14, 1992

Related U.S. Application Data

[63] Continuation-in-part of Ser. No. 644,113, Jan. 18, 1991, abandoned.

[51] Int. Cl.[6] ..... E04H 15/00

[52] U.S. Cl. ..... 135/87; 135/118; 135/902; 135/128; 135/143; 52/71; 52/86; 160/135

[58] Field of Search ..... 160/135; 135/102, 109, 135/118, 87, 97, 106, 112, 900, 901, 902; 52/71, 86

[56] References Cited

U.S. PATENT DOCUMENTS

| | | | |
|---|---|---|---|
| 2,208,458 | 7/1940 | Julian et al. | 135/87 |
| 2,576,384 | 11/1951 | Bentley | 160/135 |
| 2,619,101 | 11/1952 | McGerry et al. | 135/87 |
| 2,784,779 | 3/1957 | Knipfer et al. | 135/109 |
| 2,790,258 | 4/1957 | Freshour | 160/135 |
| 2,982,290 | 5/1961 | Hunziker | 52/71 |
| 3,187,761 | 6/1965 | De Maio | 160/135 |
| 4,436,135 | 3/1984 | Ytter | 160/135 |
| 4,685,484 | 8/1987 | Moneta | 135/117 |
| 4,838,525 | 6/1989 | Snow et al. | 135/87 |
| 4,949,490 | 8/1990 | Miller | 160/135 X |

FOREIGN PATENT DOCUMENTS

| | | | |
|---|---|---|---|
| 234126 | 5/1959 | Australia | 135/117 |
| 290905 | 2/1958 | United Kingdom | 160/351 |

*Primary Examiner*—Carl D. Friedman
*Assistant Examiner*—Christopher-Todd Kent
*Attorney, Agent, or Firm*—Paul S. Rooy

[57] ABSTRACT

A folding windbreak and shade screen comprising a plurality of sections attached by means of hinges. The folding windbreak and shade screen is secured in place in the dam configuration by means of ground stakes slidably disposed within lower housings attached to the sections. The ground stakes may be locked into upper housings in order to stack one folding windbreak and shade screen in the dam configuration atop another folding windbreak and shade screen in the dam configuration. The folding windbreak and shade screen may be installed in an arch configuration by means of arch stakes slidably disposed within arch housings, and a variety of guy lines.

18 Claims, 10 Drawing Sheets

FIG 7
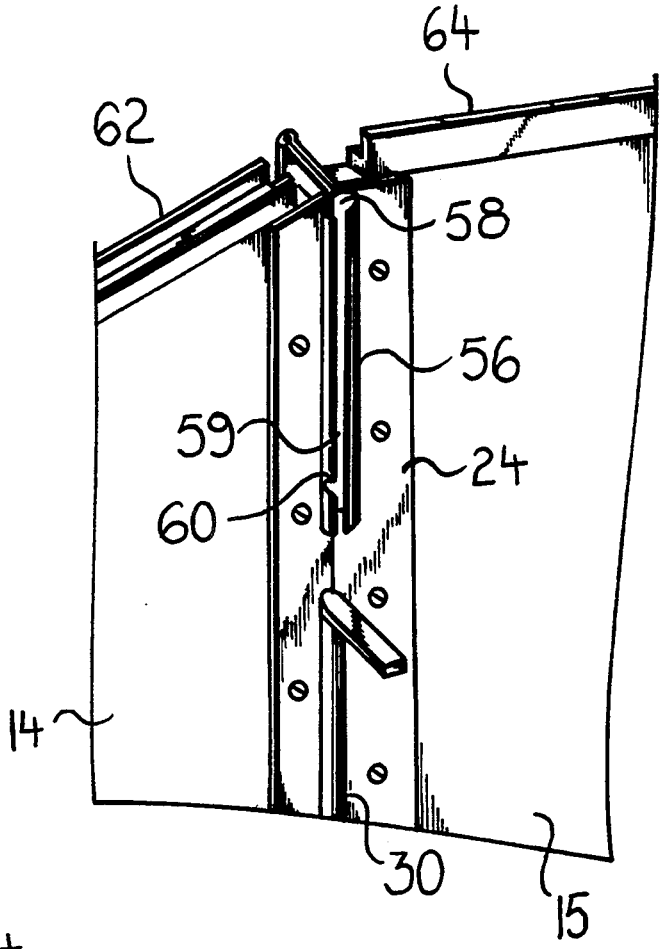
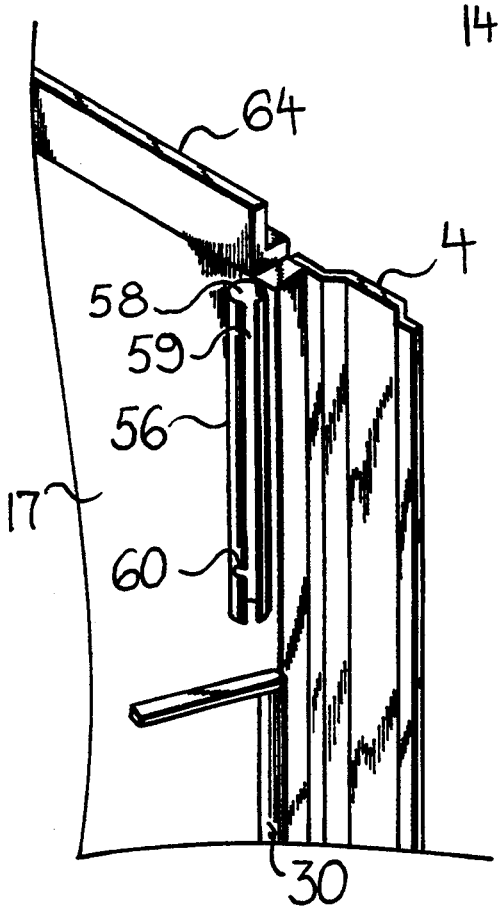
FIG 8

FOLDING WINDBREAK AND SHADE SCREEN SYSTEM

This is a Continuation in Part of application Ser. No. 07/644,113 filed Jan. 18, 1991.

BACKGROUND OF THE INVENTION

CROSS REFERENCE TO RELATED APPLICATIONS

Application No. 07/644,113 filed Jan. 18, 1991.

STATEMENT AS TO INVENTIONS MADE UNDER FEDERALLY SPONSORED RESEARCH AND DEVELOPMENT

No such rights exist.

1. Field of the Invention

This invention relates to a windbreak device which can also be used to provide shade, and in particular to a folding windbreak and shade screen system.

2. Background

Every year millions of vacationers travel to the beach for a relaxing day in the sun. Generally speaking this activity is safe and enjoyable. However the combination of sun and wind may give rise to a number of problems.

During recent years the importance of the disappearing ozone layer in blocking harmful ultraviolet rays has become apparent. Prolonged exposure to the sun increases one's chances of contracting skin cancer, cataracts, etc..

Another problem is that wind tends to blow sand which can get into any drinks, food, etc. that beachgoers may be trying to ingest.

If the wind is strong enough it can cause windburn, exacerbating any sun overexposure problems that may already exist.

Infants in portable playpens are frequently brought to the beach and require screening from the wind and sun. It is estimated that one serious sunburn during one's childhood doubles one's lifetime risk of contracting skin cancer.

Many beachgoer activities are rendered difficult or impossible in the absence of a suitable windscreen on the beach: reading, writing and any kind of book work are hard to accomplish due to the wind's effect on paper and sand blowing into the participant's eyes. Listening to electronically produced music or recordings may be short-lived due to sand blowing into delicate electronics. Art work (painting, sketching, etc.) may be hindered by the wind blowing sand onto the fresh paint, windblown sand getting between the pencil lead or artist's charcoal, etc..

Traditionally, partial solutions to the problem of wind and sun on the beach have included the use of beach umbrellas and permanent wind shelters.

Beach umbrellas provide some shade from the sun but provide little screening from the wind. Although they are generally portable, there is no provision to interlock a number of beach umbrellas together to provide a greater shade area than one umbrella by itself would be able to produce.

Permanent wind shelters suffer from a number of disadvantages, principally their lack of transportability. In other words, the beachgoer is required to go to the location of the shelter, not wherever he wants to go on the beach. In addition, if one wants to expand the size of a permanent windbreak one must undergo the relatively laborous and time-consuming process of expanding the permanent windbreak (digging holes, setting posts, stretching and attaching canvas, etc.). Finally, if the wind and/or sun change their cardinal direction of incidence, the permanent wind shelter's effectiveness may be seriously compromised.

SUMMARY OF THE INVENTION

Accordingly, it is an object of this invention to provide a folding windbreak and shade screen which may be folded into a compact bundle. Design features allowing this object to be accomplished include various sections connected to each other by means of hinges of varying sizes. Advantages to the user include ease of transportation and storage, as well as space saving during transport and storage.

Another object of the instant invention is to provide a folding windbreak and shade screen system which will be stable (that is, won't easily fall down) in the presence of wind. Design features permitting this object to be accomplished include the use of self-limiting hinges to attach the various sections, and ground stakes capable of being driven into a wide variety of soil textures which hold the folding windbreak and shade screen system in place. Advantages to the user include ease of installation and increased reliability.

Still another object of the present invention is to provide a folding windbreak and shade screen system which may be installed in a dam configuration. Design features allowing this object to be accomplished include various sections mutually attached by means of self-limiting hinges, and ground stakes slidably attached to the folding windbreak and shade screen system. Advantages to the user include shelter from the wind and sun.

Another object of the present invention is to provide a folding windbreak and shade screen system which allows one or more folding windbreak and shade screens to be stacked vertically. Invention features permitting this object to be accomplished include C channels, L channels, ground stakes having ground stake lower pins, and upper housings comprising upper housing ground stake lower pin notches. Advantages to the user include greater protection from the wind and the sun.

Still another object of the instant invention is to provide a folding windbreak and shade screen system wherein individual folding windbreak and shade screens may be installed side by side with a minimum of wind leakage between them. Design features allowing this object to be accomplished includes the installation of nesting U channels on the ends of the folding windbreak and shade screens. Advantages to the user include reduced sand and wind leakage through the aerodynamic crack between two folding windbreak and shade screens installed side by side, along with the associated comfort enhancement.

It is still another object of the present invention to provide a folding windbreak and shade screen which may be installed in an arch configuration. Invention features allowing this object to be accomplished include various sections mutually attached by means of self-limiting hinges, arch stakes slidably attached to the end sections, and a variety of guy lines to hold the folding windbreak and shade screen installed in the arch configuration in place.

It is a further object of this invention to provide a folding windbreak and shade screen system wherein two or more folding windbreak and shade screens may be installed in the arch configuration end to end. Design features allowing this object to be accomplished include C channels, L channels, ground stakes and upper housings.

BRIEF DESCRIPTION OF THE DRAWINGS

The invention, together with the other objects, features, aspects and advantages thereof will be more clearly understood from the following in conjunction with the accompanying drawings.

Nine sheets of drawings are provided. Sheet one contains FIG. 1. Sheet two contains FIGS. 2 and 3. Sheet three contains FIGS. 4A and 4B. Sheet four contains FIGS. 5 and 6. Sheet five contains FIGS. 7 and 8. Sheet six contains FIGS. 9, 10, 11 and 12. Sheet seven contains FIGS. 13 and 14. Sheet eight contains FIGS. 15, 16 and 17. Sheet nine contains FIG. 18.

FIG. 7 is a detail rear isometric view of the top of sections 4 and 5.

FIG. 8 is a detail rear isometric view of the top right corner of section 7.

COMPLETE DESCRIPTION OF THE PREFERRED EMBODIMENT

Figure 1:
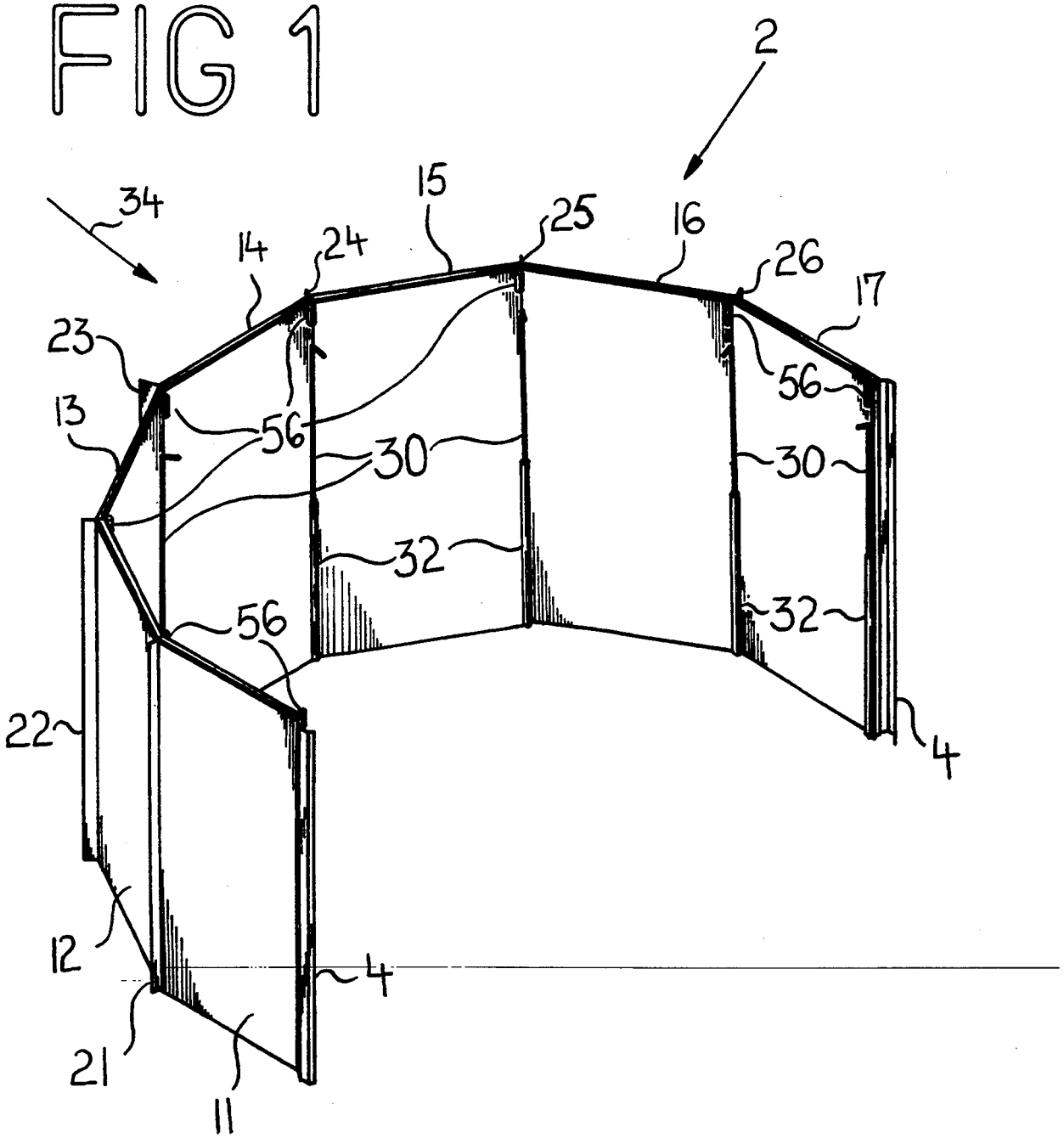
FIG. 1 is a rear isometric view of a folding windbreak and shade screen in the dam configuration.

Referring now to FIG. 1 we may observe a folding windbreak and shade screen 2 in the unfolded position in the dam configuration. End first section 11 is attached to second section 12 by means of first hinge 21. Second section 12 is attached to third section 13 by means of second hinge 22. Third section 13 is attached to center fourth section 14 by means of third hinge 23.

Center fourth section 14 is attached to fifth section 15 by means of fourth hinge 24. Fifth section 15 is attached to sixth section 16 by means of fifth hinge 25. Sixth section 16 is attached to end seventh section 17 by means of sixth hinge 26. Hinges 21–26 are permanently attached to the corresponding first section 11—seventh section 17.

U channel 4 is rigidly attached along the free end of end first section 11 and end seventh section 17.

Lower housings 32 are attached to first section 11—seventh section 17. Ground stakes 30 are slidably disposed within lower housings 32 so that ground stakes 32 may be slid into the ground to help hold folding windbreak and shade screen 2 in the dam position.

Upper housings 56 are attached to first section 11—seventh section 17 and are used when stacking two or more folding windbreak and shade screens 2 vertically.

We may observe that folding windbreak and shade screen 2 is rendered self supporting in the presence of wind blowing in the direction of wind arrow 34 because of two reasons: 1. its semi-arcuate shape when viewed from the top and, 2. ground stakes 30.

The semi-arcuate shape of folding windbreak and shade screen 2 when viewed from the top tends to maintain folding windbreak and shade screen 2 in the dam configuration depicted in FIG. 1 because end first section 11, second section 12, sixth section 16 and end seventh section 17 are disposed roughly parallel to wind arrow 34 and tend to hold third section 13, center fourth section 14 and fifth section 15, which are roughly perpendicular to wind arrow 34, up in the presence of wind blowing in the direction of wind arrow 34.

Ground stakes 30 may be slid down into the ground in order to help hold folding windbreak and shade screen 2 in place in the presence of wind.

Figure 5:
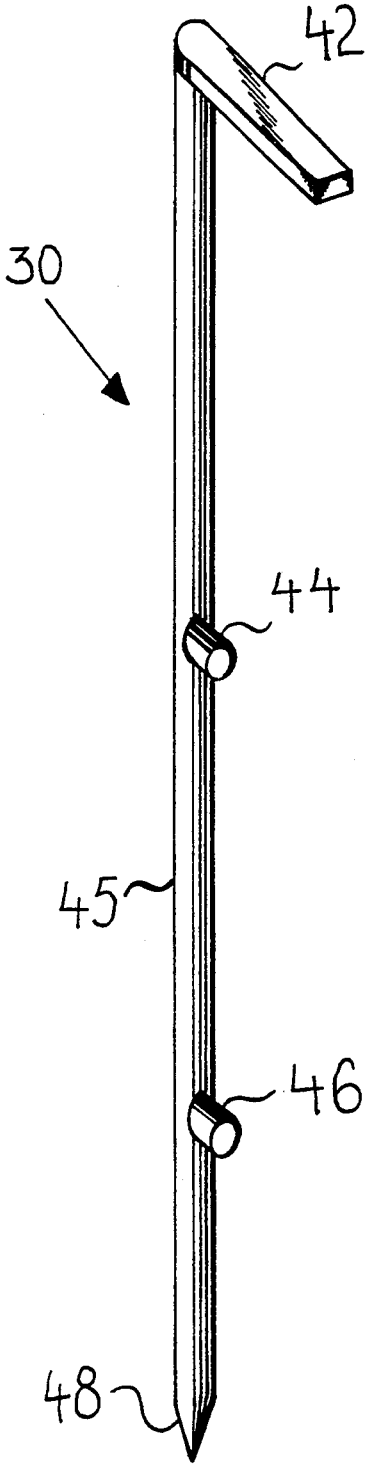
FIG. 5 is a rear isometric view of a ground stake.
Figure 6:
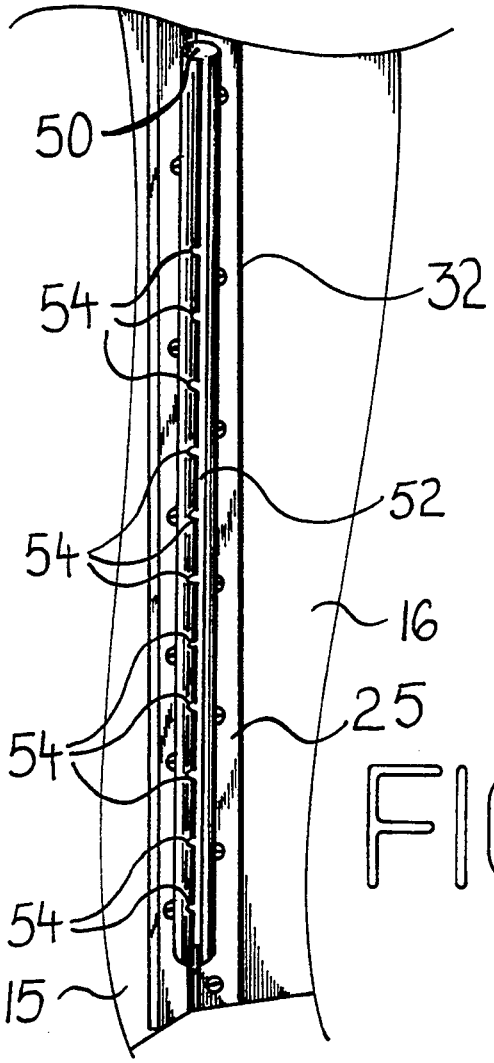
FIG. 6 is a rear isometric view of a lower housing.
Figure 9:
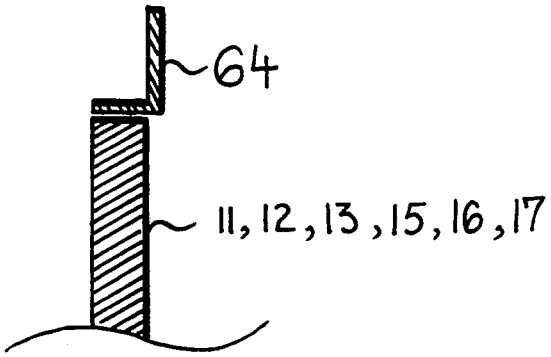
FIG. 9 is a side cross sectional view of an L channel mounted on top of a section.
Figure 10:
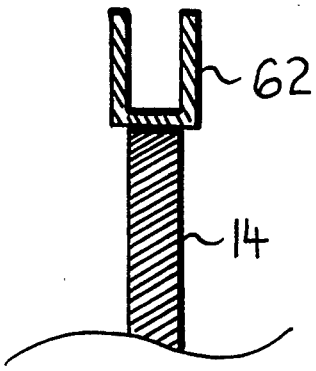
FIG. 10 is a side cross sectional view of a C channel mounted on top of the center section.
Figure 11:
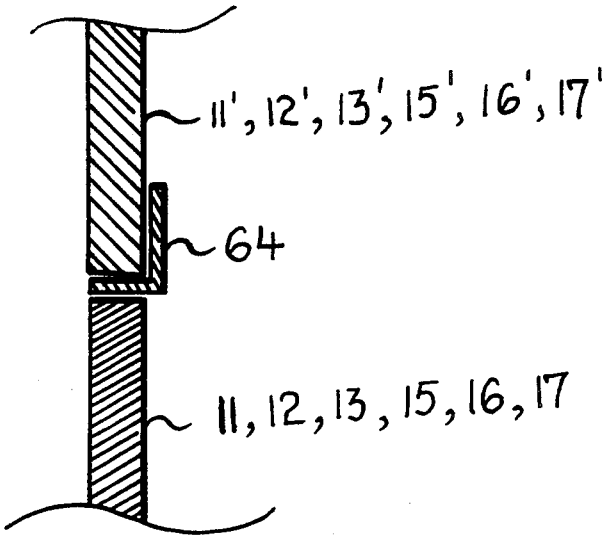
FIG. 11 is a side cross sectional view of one folding windbreak and shade screen installed on top of another folding windbreak and shade screen taken at an L channel.

FIGS. 5 and 6 illustrate how a typical ground stake 30 fits into lower housing 32. Ground stake 30 is comprised of ground stake shaft 45, ground stake handle 42 at one end of ground stake shaft 34, ground stake tip 48 at the opposite end of ground stake shaft 45, and ground stake upper pin 44 and ground stake lower pin 46 rigidly attached to ground stake shaft 45.

Lower housing 32 is comprised of lower housing bore 50 sized to admit free passage to ground stake shaft 45 (inserted as indicated by dashed arrow 51), lower housing slot 52 sized to admit free passage to ground stake upper pin 44 and ground stake lower pin 46, and lower housing ground stake upper pin notches 54 communicating with and disposed along the length of lower housing slot 52.

Ground stake 30 may be extended into the ground by pushing down on ground stake handle 42. When ground stake tip 48 is at the desired depth, ground stake upper pin 44 is rotated into the nearest lower housing ground stake upper pin notch 54, thereby locking ground stake 30 in place relative to lower housing 32. Alternately, ground stake 30 may be retracted into lower housing 32 and rotated to engage ground stake lower pin 44 in a lower housing ground stake upper pin notch 54, thereby locking ground stake 30 in the retracted position relative to lower housing 32 for transport, storage, etc.

Figure 2:
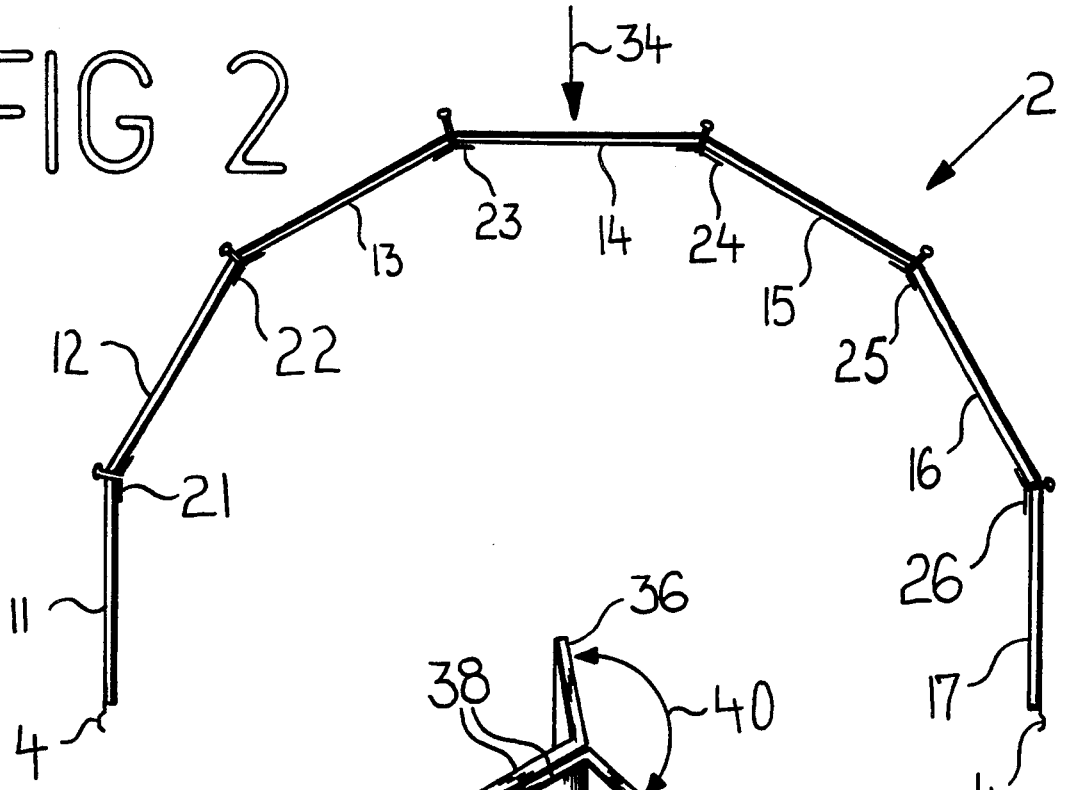
FIG. 2 is a top view of a folding windbreak and shade screen in the unfolded position in the dam configuration.
Figure 3:
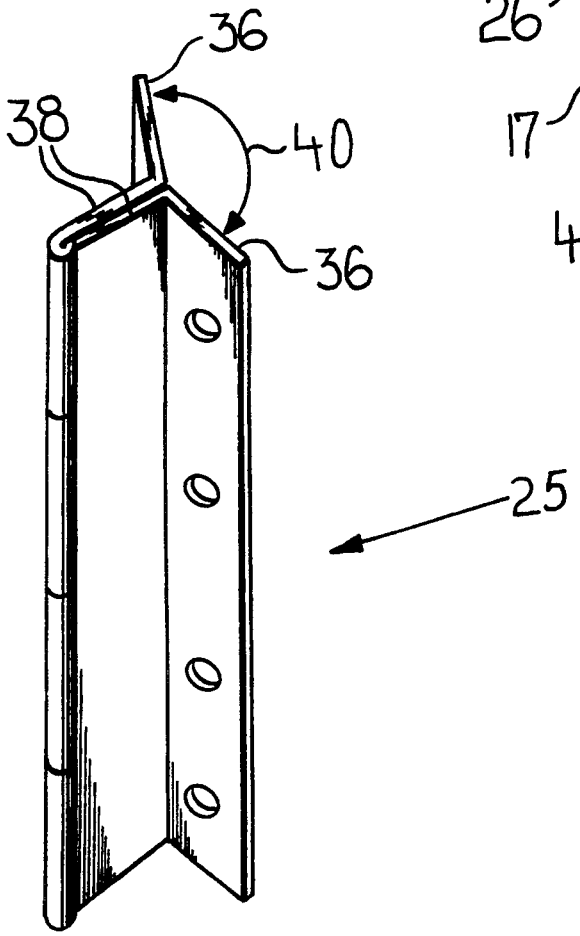
FIG. 3 is a side isometric view of a hinge.

FIG. 2 is a top isometric view of folding windbreak and shade screen 2 in the unfolded position. As may be observed from FIG. 3, hinges 21–26 are self-limiting hinges. FIG. 3 is a side isometric view of fifth hinge 25 in the open position. Fifth hinge 25 is representative of the other hinges.

Fifth hinge 25 is comprised of a pair of upper arms 38, mutually hingedly attached. Each upper arm 38 has a fore arm 36 rigidly attached. When hinge 25 is in the extreme open position (that is, when upper arms 38 are immediately adjacent each other) the angle defined by fore arms 38 is section angle 40. In the preferred embodiment section angle 40 is approximately 30 degrees.

Figure 18:
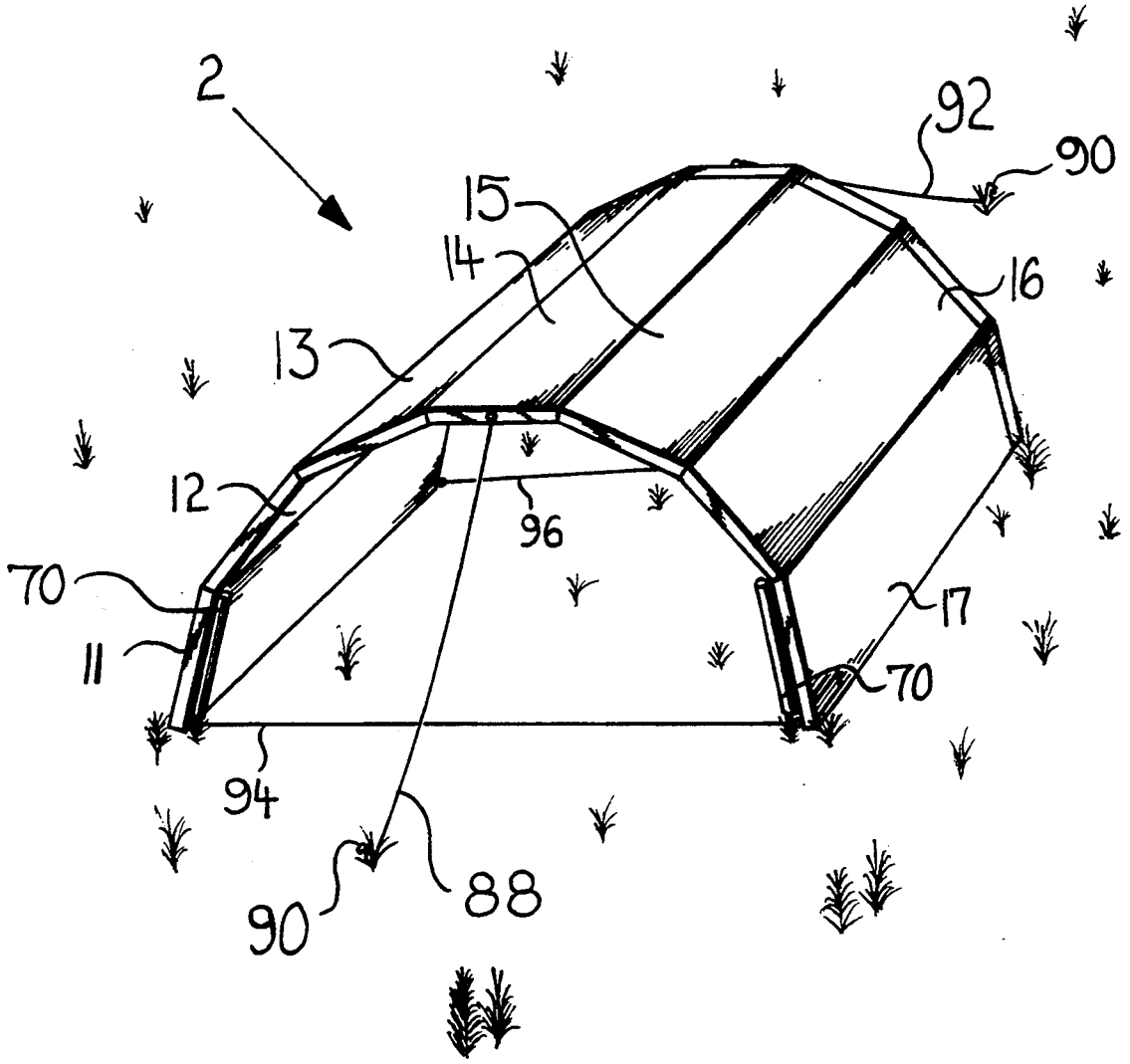
FIG. 18 is a front isometric view of a folding windbreak and shade screen installed in the arch configuration.

As may be appreciated from the top view of folding windbreak and shade screen 2 shown in FIG. 2, the action of limiting the distance between the two U channels 4 to that distance at which all hinges (first 21–sixth 26) are in the extreme open position (as depicted in FIGS. 2 and 3) renders folding windbreak and shade screen 2 shape stable and self-supporting in the presence of wind blowing in the direction of wind arrow 34. U channels 4 may be held at this distance by driving ground stakes 30 into the ground, or, alternately by employing front bottom guy line 94 and rear bottom guy line 96 as illustrated in FIG. 18.

Figure 4A:
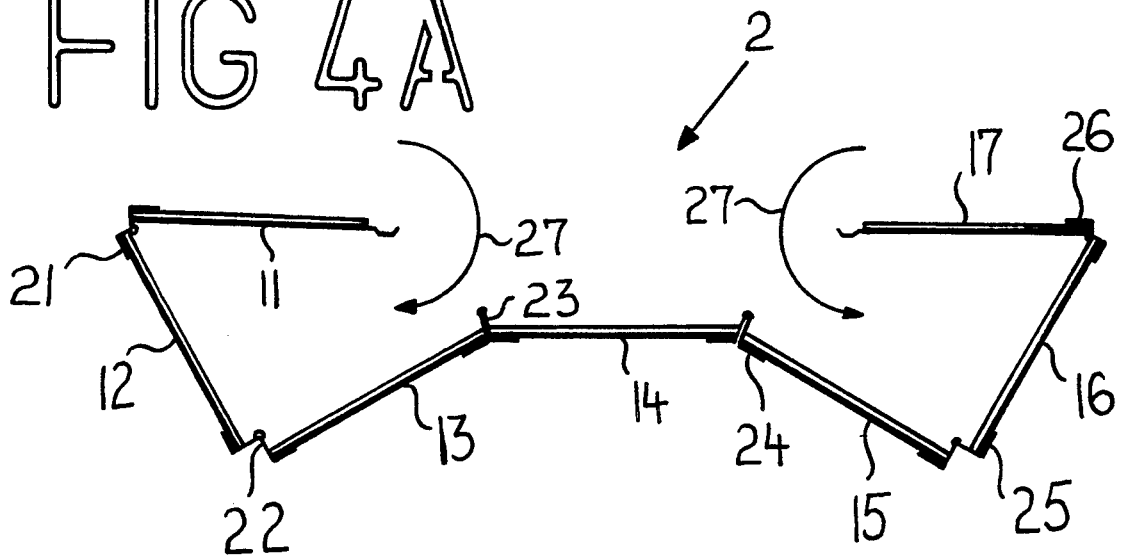
FIG. 4A is a top view of a folding windbreak and shade screen in the process of being folded.
Figure 4B:
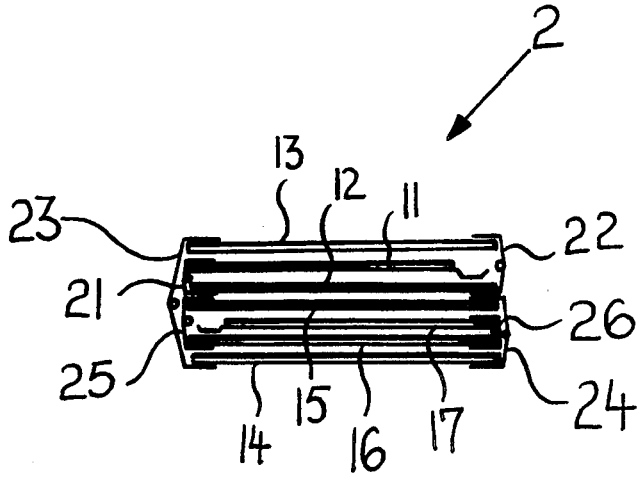
FIG. 4B is a top view of a folding windbreak and shade screen in the folded position.

FIGS. 4A and 4B show how folding windbreak and shade screen 2 is folded into the folded position.

First, any extended ground stakes 30 are retracted into the appropriate lower housings 32. Then the two ends of folding windbreak and shade screen 2 are "rolled up" towards the front center of folding windbreak and shade screen 2 as indicated by fold-up arrows 27.

The folded configuration of folding windbreak and shade screen 2 is depicted in the top view of FIG. 4B. Note that first hinge 21—sixth hinge 26 are now in the closed position. The fore arms 36 of first hinge 21 are far enough apart to accommodate the thickness of end first section 11 and second section 12 between them. The fore arms 36 of sixth hinge 26 are far enough apart to accommodate the thickness of sixth section 16 and end seventh sect 17 between them.

The fore arms 36 of second hinge 22 are far enough apart to accommodate the thickness of end first section 11, second section 12 and third section 13 between them. The fore arms 36 of fifth hinge 25 are far enough apart to accommodate the thickness of end seventh section 17, sixth section 16 and fifth section 15 between them.

The fore arms 36 of fourth hinge 24 are far enough apart to accommodate the thickness of end seventh section 17, sixth section 16, fifth section 15 and center fourth section 14 between them.

The fore arms 36 of third hinge 23 are far enough apart to accommodate the thickness of end first section 11, end seventh section 17, center fourth section 13 and sections 12, 13, 15 and 16 between them.

Note that in the folded position, the height and width dimensions of folding windbreak and shade screen 2 are reduced by a factor of approximately 7.

FIG. 7 is a detail rear isometric view of the upper part of center fourth section 14 hingedly attached to fifth section 15 by means of fourth hinge 24. We can observe C channel 62 attached to the upper edge of center fourth section 14. L channel 64 is attached to the upper edge of fifth section 15. L channel 64 is also attached to the top of end first section 11, second section 12, third section 13, sixth section 16 and end seventh section 17.

FIG. 8 is a detail rear isometric view of the upper right part of end seventh section 17. L channel 64 is attached to the upper edge of end seventh section 17. Upper housing 56 is attached to the upper part of end seventh section 17. U channel 4 is attached to the non-hinged end of end seventh section 17.

Upper housing 56 is comprised of upper housing bore 58 sized to freely admit ground stake shaft 45, upper housing slot 59 sized to freely admit passage to ground stake lower pin 46, and upper housing ground stake lower pin notch 60 sized to admit ground stake lower pin 46.

C channel 62, L channel 64 and upper housings 56 are used when stacking two or more folding windbreak and shade screens 2 vertically.

Figure 12:
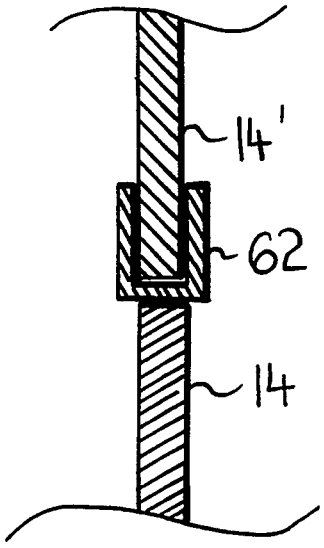
FIG. 12 is a side cross sectional view of one folding windbreak and shade screen installed on top of another folding windbreak and shade screen taken at a C channel.
Figure 19:
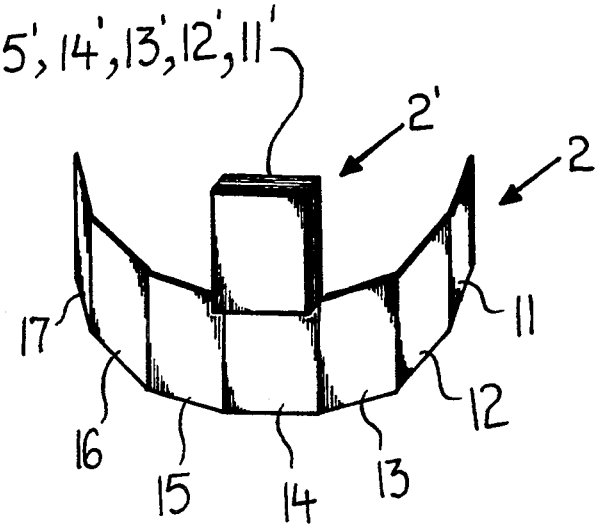
FIGS. 19–21 are front isometric views of a folding windbreak and shade screen system 2' being installed atop another folding windbreak and shade screen system 2.
Figure 20:
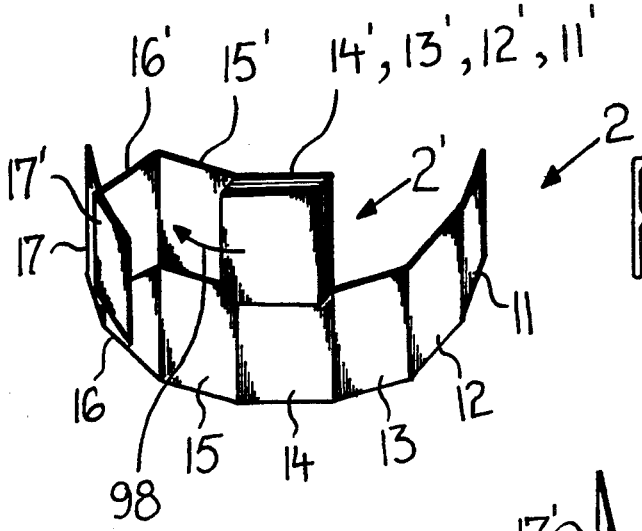
Figure 21:
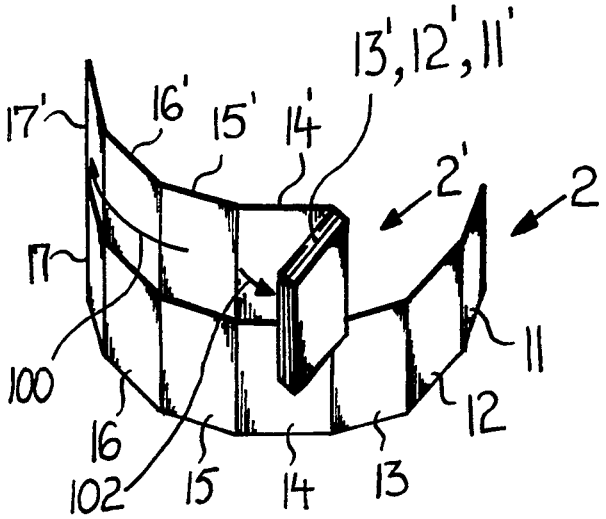

The steps involved in stacking folding windbreak and shade screen 2' having first section 11'—seventh section 17' on top of folding windbreak and shade screen 2 having first section 11—seventh section 17 with C channel 62 attached to the upper edge of center fourth section 14 and L channel 64 attached to the upper edge of first section 11—third section 13 and fifth section 15—seventh section 17 (see FIGS. 9–12 and 19–21) are as follow:

1. (see FIGS. 12 and 19) Place the bottom edge of center fourth section 14' of folding windbreak and shade screen 2' into C channel 62 of folding windbreak and shade screen 2 as depicted in FIGS. 12 and 19.

2. (see FIGS. 11 and 20) Unfold fifth section 15' as indicated by unfold arrow 98 until the bottom of fifth section 15' butts up against the L channel 64 attached to the top of fifth section 15. Slide the ground stake 30 slidably attached to fifth section 15' into the ground stake housing 56 attached to the top of fifth section 15 and then rotate to engage ground stake lower pin 46 into the corresponding upper housing ground stake lower pin notch 60 to lock the ground stake 30 slidably attached to fifth section 15' into the ground stake housing 56 attached to fifth section 15.

3. (see FIGS. 11 and 21) Unfold sixth section 16' as indicated by unfold arrow 100 until the bottom of sixth section 16' butts up against the L channel 64 attached to the top of sixth section 16. Slide the ground stake 30 slidably attached to sixth section 16' into the ground stake housing 56 attached to the top of sixth section 16 and then rotate to engage ground stake lower pin 46 into the corresponding upper housing ground stake lower pin notch 60 to lock the ground stake 30 slidably attached to sixth section 16' into the ground stake housing 56 attached to sixth section 16.

4. (see FIGS. 11 and 21) Unfold end seventh section 17' as indicated by unfold arrow 100 until the bottom of end seventh section 17' butts up against the L 64 channel attached to the top of end seventh section 17. Slide the ground stake 30 slidably attached to end seventh section 17' into the ground stake housing 56 attached to the top of end seventh section 17 and then rotate to engage ground stake lower pin 46 into the corresponding upper housing ground stake lower pin notch 60 to lock the ground stake 30 slidably attached to end seventh section 17' into the ground stake housing 56 attached to end seventh section 17.

5. Unfold sections 13', 12', and 11' as indicated by unfold arrow 102 until section 13', 12' and 11' butt up against the L channel 64 attached to the top of sections 13, 12 and 11 respectively. Slide the ground stakes 30 slidably attached to sections 13', 12' and 11' into the corresponding ground stake housings 56 attached to sections 13, 12 and 11 respectively, then rotate ground stakes 30 to engage ground stake lower pins 46 into the corresponding upper housing ground stake lower pin notches 60, thereby locking folding windbreak and shade screen 2' atop folding windbreak and shade screen 2. Note that either side of folding windbreak and shade screen 2' may be first unfolded and locked atop folding windbreak and shade screen 2. That is to say, depending on how folding windbreak and shade screen 2' is folded, sections 15', 16' and 17' may be first unfolded and locked atop folding windbreak and shade screen 2 (as is the order described above), or sections 13', 12' and 11' may be unfolded and locked in first, followed by sections 15', 16' and 17'.

Figure 13:
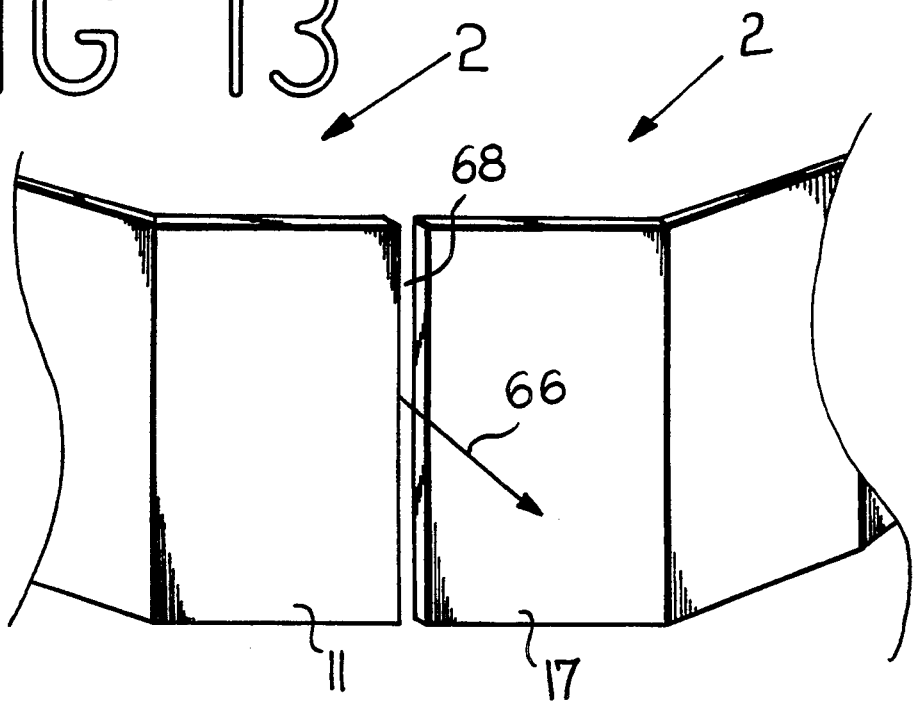
FIG. 13 is a front isometric view of the aerodynamic crack produced when two folding windbreak and shade screens are installed side by side.
Figure 14:
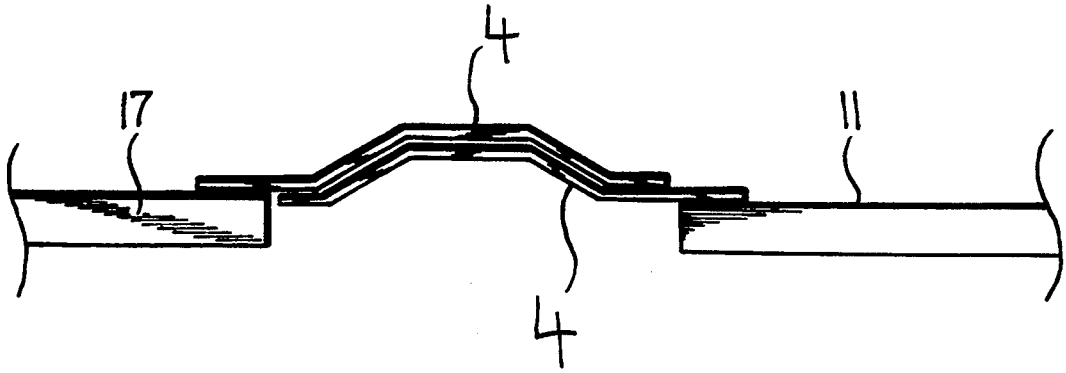
FIG. 14 is a top view of two nesting U channels sealing the aerodynamic crack in a side by side installation.

FIGS. 13 and 14 illustrate how interlocking U channels 4 seal the aerodynamic crack 68 created when two or more folding windbreak and shade screens 2 are installed side by side.

In FIG. 14 we observe aerodynamic crack 68 created when two folding windbreak and shade screens 2 are installed side by side. Wind carrying sand, etc. may pass through aerodynamic crack 68 between end first section 11 of the left folding windbreak and shade screen 2 and end seventh section 17 of the right folding windbreak and shade screen 2, as depicted by wind arrow 66.

FIG. 14 is a top view showing how the U channel 4 attached to one folding windbreak and shade screen 2 may be interlocked with the U channel 4 attached to an adjacent folding windbreak and shade screen 2 in order to prevent wind carrying sand, etc. from passing between the two folding windbreak and shade screens 2.

Figure 15:
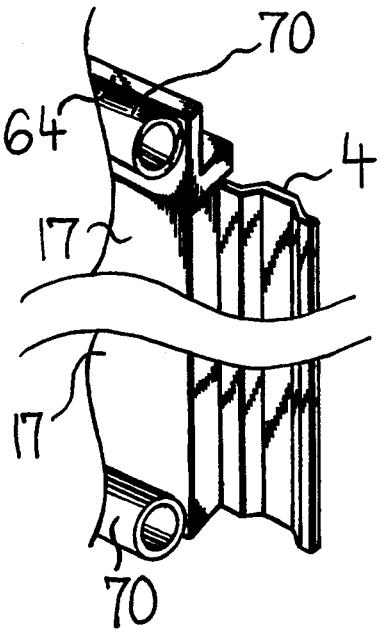
FIG. 15 is a rear detail isometric view of the top and bottom of section 7.

FIGS. 15–18 depict an alternate embodiment of folding windbreak and shade screen 2 wherein an arch configuration may be obtained. Arch housings 70 are attached at the top and bottom of end first section 11 and end seventh section 17 as depicted in FIG. 15.

Figure 17:
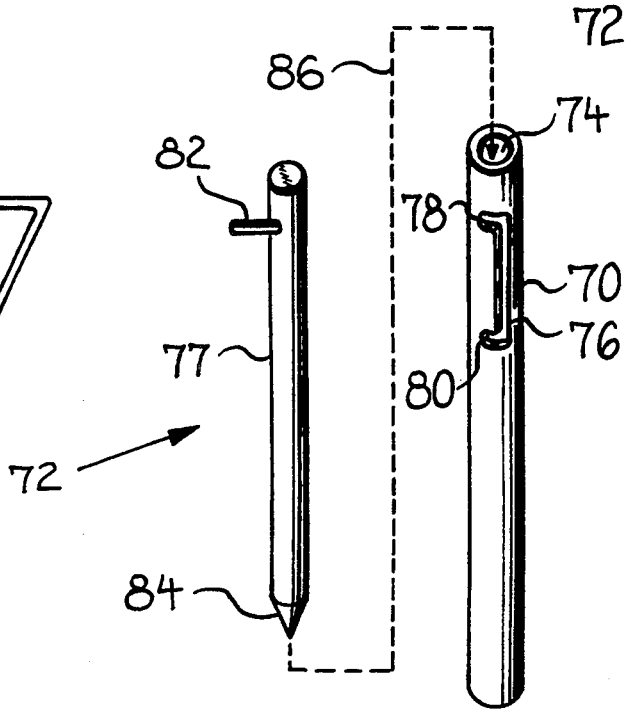
FIG. 17 is a rear isometric view of an arch stake and an arch housing.

As seen in FIG. 17, arch housing 70 is comprised of arch housing bore 74, arch housing slot 76, arch housing slot upper notch 78 and arch housing slot lower notch 80.

Arch stake 72 is slidably disposed within arch housing bore 74. Arch stake 72 is comprised of arch stake shaft 77 sized to freely slide in arch housing bore 74 (as indicated by dashed arrow 86), arch stake tip 84 at one end of arch stake shaft 77, and arch stake pin 82 sized to slide through arch housing slot 76 and engage in arch housing slot upper notch 78 or arch housing slot lower notch 80. Arch stake pin 82 may be engaged in arch housing slot upper notch 78 in order to lock arch stake 72 in the retracted position within arch housing 70 for transportation or storage. Arch stake pin 82 may be engaged in arch housing slot lower notch 80 in order to lock arch stake in the extended position when folding windbreak and shade screen 2 is installed in the arch configuration (see step 3 below).

FIG. 18 shows folding windbreak and shade screen 2 installed in the arch configuration. Front bottom guy line 94 is attached to end first section 11 at one end and end seventh section 17 at the other. Rear bottom guy line 96 is attached to end first section 11 at one end and end seventh section 17 at the other.

Front guy line 88 is attached to center fourth section 14 at one end and stake 90 (driven into the ground) at the other. Rear guy line 92 is attached to center fourth section 14 at one end and stake 90 (driven into the ground) at the other.

Folding windbreak and shade screen 2 may be installed in the arch configuration depicted in FIG. 18 as follows:

1. Tighten front bottom guy line 94 and rear bottom guy line 96 to the distance at which first hinge 21—sixth hinge 26 are in the maximum open position.

2. Place folding windbreak and shade screen 2 in the orientation relative to the ground depicted in FIG. 18. Drive stakes 90, then attach and tighten front guy line 88 and rear guy line 92 to stakes 90.

3. Slide arch stakes 72 into the ground and lock in place by rotating arch stake pin 82 into arch housing slot lower notch 80.

Figure 16:
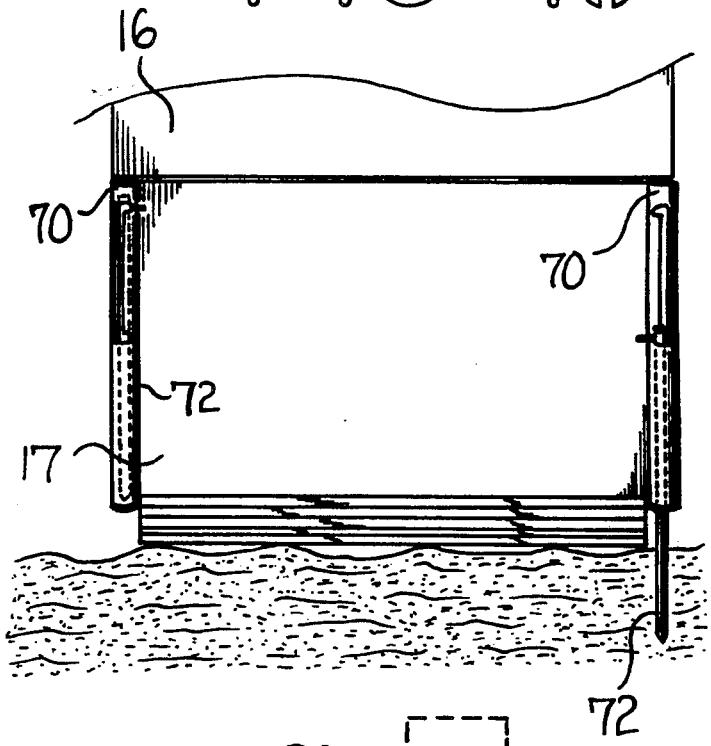
FIG. 16 is a side view of a folding windbreak and shade screen installed in the arch configuration.

FIG. 16 is a side view of end seventh section 17 installed in the arch configuration. The lefthand arch stake 70 is retracted within the lefthand arch housing 70; the righthand arch stake 72 has been extended into the ground.

Multiple folding windbreak and shade screens 2 may be installed end to end in the arch configuration by placing the lower edges of one folding windbreak and shade screen 2 into the corresponding C channel 62 and L channel 64 of the other folding windbreak and shade screen 2, then sliding ground stakes 30 into the appropriate upper housings 56, followed by rotating the ground stakes 30 to lock them in place relative to the corresponding upper housings 56 as described previously in the vertical stacking procedure.

Sections 11–17 may be fabricated of light weight metal, synthetic material, or other suitable material. Guy lines 94, 96, 88 and 90 may be made of nylon, synthetic strap or other suitable material. All other components may be made of aluminum, stainless steel, synthetic or other suitable material.

While a preferred embodiment of the invention has been illustrated herein, it is to be understood that changes and variations may be made by those skilled in the art without departing from the spirit and scope of the appending claims.

DRAWING ITEM INDEX 2 folding windbreak and shade screen
4 U channel
11 end first section
12 second section
13 third section
14 center fourth section
15 fifth section
16 sixth section
17 end seventh section
21 first hinge
22 second hinge
23third hinge
24 fourth hinge
25 fifth hinge
26 sixth hinge
27 fold-up arrow
30 ground stake
32 lower housing
34 wind arrow
36 fore arm
38 upper arm
40 section angle
42 ground stake handle
44 ground stake upper pin
45 ground stake shaft 46 ground stake lower pin
48 ground stake tip
50 lower housing bore
51 dashed arrow
52 lower housing slot
54 lower housing ground stake upper pin notch
56 upper housing
58 upper housing bore
59 upper housing slot
60 upper housing ground stake lower pin notch
62 C channel
64 L channel
66 wind arrow
68 aerodynamic crack
70 arch housing
72 arch stake
74 arch housing bore
76 arch housing slot
77 arch stake shaft
78 arch housing slot upper notch
80 arch housing slot lower notch
82 arch stake pin
84 arch stake tip
86 dashed arrow
88 front guy line
90 stake
92 rear guy line
94 front bottom guy line
96 rear bottom guy line
98 unfold arrow
100 unfold arrow
102 unfold arrow

I claim:

1. A folding windbreak and shade screen comprising:
a plurality of sections hingedly attached,
at least one lower housing attached to at least one of the sections,
a ground stake slidably disposed within each said at least one lower housing, and
U channel attached to two of said plurality of sections, said U-channel comprising two legs connected by a web, said U-channel attached to said two sections solely by means of one of said two legs.

2. The folding windbreak and shade screen of claim 1 wherein the means of hingedly attaching said sections comprises self-limiting hinges whereby a section angle between adjacent sections may be established when the hinge attaching said adjacent sections has been fully opened.

3. The folding windbreak and shade screen of claim 2 wherein each said self-limiting hinges comprises:
a pair of hingedly attached upper arms, and
a fore arm rigidly attached to each of the upper arms.

4. The folding windbreak and shade screen of claim 1 further comprising:
two end sections, each of the said end sections having one side hingedly attached to one of the sections, and
at least one arch housing attached to each of the said end sections, and
an arch stake disposed within each said arch housing.

5. The folding windbreak and shade screen of claim 4 wherein said arch stake further comprises:
an arch stake shaft,
an arch stake pin rigidly attached to said arch stake shaft, and
an arch stake tip at one end of said arch stake shaft.

6. The folding windbreak and shade screen of claim 5 wherein said arch housing is comprised of:
an arch housing bore sized to admit said arch stake shaft,
an arch housing slot sized to admit said arch stake pin,
an arch housing slot upper notch communicating with said arch housing slot, said arch housing slot upper notch being sized to admit said arch stake pin, and
an arch housing slot lower notch communicating with said arch housing slot, said arch housing slot lower notch being sized to admit said arch stake pin.

7. The folding windbreak and shade screen of claim 6 further comprising:
a rear bottom guy line connecting said end sections, and
a front bottom guy line connecting said end sections.

8. The folding windbreak and shade screen of claim 7 further comprising:
a front guy line attached to one of the sections, and
a rear guy line attached to one of the sections.

9. A folding windbreak and shade screen comprising:
a plurality of sections hingedly attached,
at least one lower housing attached to at least one of the sections,
a ground stake slidably disposed within each said at least one housing,
U channel attached to two said sections,
a center fourth section hingedly attached to said sections, said center fourth section being centrally disposed within said folding windbreak and shade screen,
a C channel sized to admit passage to the lower edge of each said sections or the lower edge of said center fourth section, said C channel being attached to the upper edge of said center fourth section, and
L channel sized to accommodate the lower edge of each said section, said L channel being attached to the upper edge of the said sections.

10. The folding windbreak and shade screen of claim 9 wherein said ground stake is comprised of:
a ground stake shaft,
a ground stake tip at one end of said ground stake shaft,
a ground stake handle at the other end of said ground stake shaft,
a ground stake upper pin rigidly attached to said ground stake shaft, and
a ground stake lower pin rigidly attached to said ground stake shaft.

11. The folding windbreak and shade screen of claim 10 wherein said lower housing is comprised of:
a lower housing bore sized to admit said ground stake shaft,
a lower housing slot sized to admit said ground stake upper pin and said ground stake lower pin, and
a plurality of lower housing ground stake upper pin notches communicating with said lower housing slot and sized to admit said ground stake upper pin or said ground stake lower pin.

12. The folding windbreak and shade screen of claim 11 further comprising at least one upper housing attached to the upper part of said center fourth section or at the upper part of least one said said sections.

13. The folding windbreak and shade screen of claim 12 wherein each said upper housings is comprised of:

an upper housing bore sized to admit said ground stake shaft, an upper housing slot sized to admit said ground stake lower pin, and an upper housing ground stake lower pin notch communicating with said upper housing slot, said upper housing ground stake lower pin notch being size to admit said ground stake lower pin.

14. A folding windbreak and shade screen comprising:

an end first section adjacent to and attached to a second section by means of a first hinge, a third section adjacent to and attached to said second section by means of a second hinge, a center fourth section adjacent to and attached to said third section by means of a third hinge, a fifth section adjacent to and attached to said center fourth section by means of a fourth hinge, a sixth section adjacent to and attached to said fifth section by means of a fifth hinge, an end seventh section adjacent to and attached to said sixth section by means of a sixth hinge, L channel attached to the upper edge of said end first section, said end seventh section, and said second section, third section, fifth section and sixth section, C channel attached to the upper edge of said center fourth section, at least one lower housing attached to at least one of the sections, a ground stake slidably disposed within each of said at least one lower housing, and at least one upper housing sized to slidably accommodate one said ground stake attached to at least one of the sections.

15. The folding windbreak and shade screen of claim 14 wherein each of the hinges is comprised of a pair of hingedly attached upper arms and a fore arm rigidly attached to each said upper arm, the fore arms of said first hinge being far enough apart in the closed position to accommodate the thickness of said end first section and said second section, the fore arms of said second hinge being far enough apart in the closed position to accommodate the thickness of said end first section, said second section and said third section, the fore arms of said sixth hinge being far enough apart in the closed position to accommodate the thickness of said end seventh section and said sixth section, the fore arms of said fifth hinge being far enough apart in the closed position to accommodate the thickness of said end seventh section, said sixth section and said fifth section, the fore arms of said fourth hinge being far enough apart in the closed position to accommodate the thickness of said end seventh section, said sixth section, said fifth section and said center fourth section, and the fore arms of said third hinge being far enough apart in the closed position to accommodate the thickness of said end first section, said second section, said third section, said center fourth section, said fifth section, said sixth section and said end seventh section, whereby said folding windbreak and shade screen may be folded for case of transport and storage.

16. The folding windbreak and shade screen of claim 14 further comprising U channel attached to the side of said end first section opposite said first hinge, and to the side of said end seventh section opposite said sixth hinge.

17. The folding windbreak and shade screen of claim 14 further comprising:

at least one arch housing attached to said end first section, at least one arch housing attached to said end seventh section, and an arch stake slidably disposed within each said arch housing.

18. The folding windbreak and shade screen of claim 17 further comprising:

a front bottom guy line attached to said end first section and said end seventh section, a rear bottom guy line attached to said end first section and said end seventh section, a front guy line attached to said center fourth section and a first stake, a rear guy line attached to said center fourth section and a second stake.

* * * * *